US005096120A

United States Patent [19]

Luckarz

[11] Patent Number: 5,096,120

[45] Date of Patent: Mar. 17, 1992

[54] PROCESS AND APPARATUS TO GUIDE A SPRAY MATERIAL TO A PLURALITY OF SPRAYING STATINS

[75] Inventor: Miroslav Luckarz, Ingersheim, Fed. Rep. of Germany

[73] Assignee: Behr Industrieanlaguen GmbH & Co., Bietigheim Bissinger Fed. Rep. of Germany

[21] Appl. No.: 663,809

[22] Filed: Mar. 4, 1991

Related U.S. Application Data

[63] Continuation of Ser. No. 370,692, Jun. 23, 1989, abandoned.

[30] Foreign Application Priority Data

Jun. 24, 1988 [DE] Fed. Rep. of Germany ..... 3821440

[51] Int. Cl.[5] ..... B05B 9/00

[52] U.S. Cl. ..... 239/75; 239/76

[58] Field of Search ..... 239/75, 76, 124–127

[56] References Cited

U.S. PATENT DOCUMENTS

| | | | |
|---|---|---|---|
| 2,762,652 | 9/1956 | Carter | 239/75 |
| 2,881,796 | 4/1959 | Garraway | 239/75 |
| 2,914,253 | 11/1959 | Jobus et al. | 239/75 |
| 3,787,882 | 1/1974 | Fillmore et al. | 417/43 |
| 4,197,995 | 4/1980 | Campbell et al. | 239/127 |
| 4,278,205 | 7/1981 | Binoche | 239/75 |
| 4,592,305 | 6/1986 | Scharfenberger | 239/75 |
| 4,682,710 | 7/1987 | Turner et al. | 239/76 |

*Primary Examiner*—Andres Kashnikow
*Assistant Examiner*—Kevin P. Weldon
*Attorney, Agent, or Firm*—Watson, Cole, Grindle & Watson

[57] ABSTRACT

A process and apparatus to guide spray material such as paints and lacquers to a plurality of spraying stations by a common ring line for spray material; in the process and apparatus, pressure, speed, volume flow and/or mass flow of the spray material flowing in the ring line are continuously monitored and adjusted to the respective requirements such that the spray material flowing in the ring line is conserved as such as possible. Thus, negative effects on the quality of the spray material are avoided even with long circulation times for the spray material.

2 Claims, 3 Drawing Sheets

PROCESS AND APPARATUS TO GUIDE A SPRAY MATERIAL TO A PLURALITY OF SPRAYING STATINS

This application is a continuation of application Ser. No. 370,692 filed June 23, 1989, now abandoned.

The present invention relates to a process and apparatus for guiding a sprayable material such as paints and lacquers to a plurality of spraying stations by means of a common recirculating line of spraying stations by means of a common recirculating line and, more particularly, to a process and apparatus where pressure, speed, volume flow and/or mass flow of the spray material flowing in the recirculating line are continuously monitored and adjusted to the respective requirements such that the spray material flowing in the recirculating line is conserved as much as possible.

In a spraying apparatus with several spraying stations, which is commonly known as a conveyorized finishing line, the spray material is guided to the individual spraying station by means of a recirculating line which runs from a supply container with feed pump, past the spraying stations and back again to the supply container. A tapping point, which comprises a controllable tap valve and a spray material connecting pipe to the sprayer of the spraying station, is on the recirculating line in the region of the spraying stations. The feed pump is generally operated so as to assure that the spraying operation at each spraying station has the requisite spraying pressure and the requisite quantity of spray material under varying conditions. As a consequence, the process is largely performed at a comparatively high pressure and at a high rate of speed of the spray material flowing in the ring line.

In depth studies have shown that many paints, in particular metallic type paints and water type paints, are sensitive to loads, in particular shearing load, to which they are subjected when flowing through the pipes. Negative effects on the paints, which depend especially on the feed pressure and the flow speed and, above all, on the duration of load effect, are different for each spray material. Statistical analyses have demonstrated that when such conveyorized finishing lines are viewed over a long period of time, the actual spraying operation utilizes only a comparatively small percentage of the overall time. Thus, the spray material is subjected to special loads due to the fact that it flows through the recirculating line at a high pressure and high speed, even during long pauses in the actual spraying operation. However, this problem cannot be simply solved by reducing the flow pressure and speed of the spray material in the recirculating line to a pre-selected value, for example, to 50% of normal during a pause in the spraying operation. On one hand, the required spray pressure and the desired quantity of spray material are immediately present. On the other hand, the process and the load are affected by a variety of factors, such as the temperature of the spray material and the properties of the respective spray material. Thus, for example, many paints tend to unmix or the solid particles precipitate at too low a flow speed.

SUMMARY OF THE INVENTION

Therefore, it is an object of the present invention to provide a process and apparatus with which it is possible, on the one hand, to meet the above-mentioned requirements of the spraying operation, and, on the other hand, to protect the spray material flowing in the recirculating line as much as possible, thus avoiding as such as possible the effects of long-term loads. A process for guiding spray material in a spraying apparatus comprising a plurality of spraying stations having at least one sprayer supplied with spray material by a common spray material recirculating line which runs from a supply container with a feed pump, past the spraying stations and back to the supply container, and tapping points which each comprise a controllable tap valve and a spray material connection for the sprayer of the spraying station, the process comprising continuously monitoring, in the area of the spraying station on the recirculating line, the variables of pressure, speed, volume flow and/or mass flow of the spray material flowing in the recirculating line, and adjusting the variables by means of the feed pump such that, based on the properties of the spray material, including the rheological structure of the spray material, the temperature of the spray material, the opening or closing state of the tap valve and the sprayers and the quantity of spray material required by the sprayers, the pressure, the speed, the volume flow and/or the mass flow of the spray material are at an optimal low value. A spraying apparatus comprising a plurality of spraying stations having at least one sprayer supplied with spray material by a common spray material recirculating line which runs from a supply container with a feed pump, past the spraying stations and back to the supply container, and tapping points which each comprise a controllable tap valve and a spray material connection for the sprayer of the spraying station, the apparatus further comprising means for continuously monitoring, in the area of the spraying station on the recirculating line, the variables of pressure, speed, volume flow and/or mass flow of the spray material flowing in the recirculating line, and means for adjusting the variables by means of the feed pump such that, based on the properties of the spray material, including the rheological structure of the spray material, the temperature of the spray material, the opening or closing state of the tap valve and the sprayers and the quantity of spray material required by the sprayers, the pressure, the speed, the volume flow and/or the mass flow of the spray material are at an optimal low value.

Thus, according to the inventive process and apparatus, the variables of pressure, speed, volume flow and/or mass flow of the spray material flowing in the recirculating line are continuously monitored, these variables being subjected to a continuous matching with respect to an optimal low value, and, in particular, based on the properties of the respective spray material, the temperature of the spray material and the respective operating condition spraying apparatus.

Further features, objects and advantages of the present invention will become more fully apparent from a detailed consideration of the arrangement and construction of the constituent parts as set forth in the following description taken together with the accompanying drawings.

BRIEF DESCRIPTION OF THE DRAWINGS

The invention is explained in detail with reference to the drawings in which.

DETAILED DESCRIPTION OF THE PREFERRED EMBODIMENTS

Figure 1:
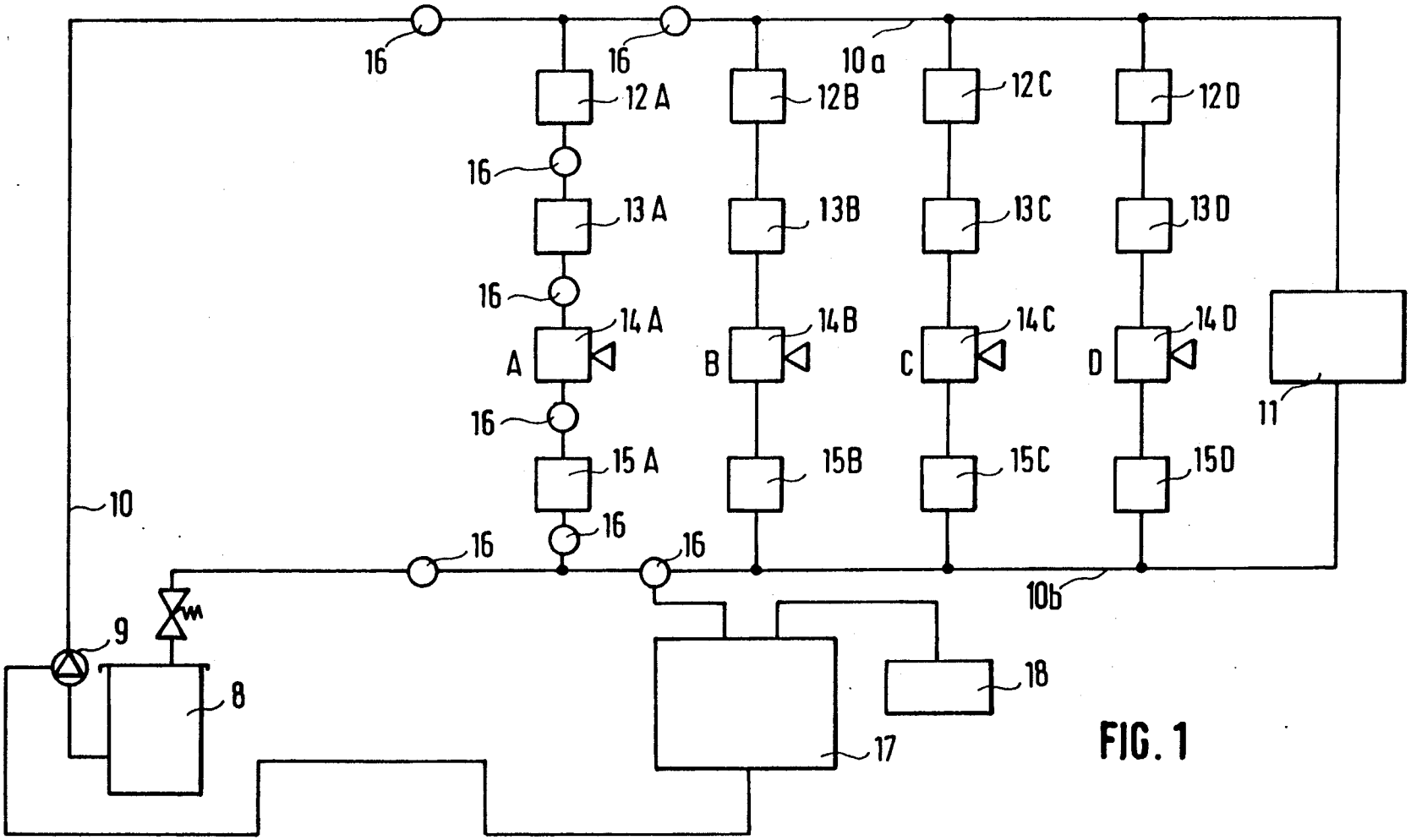
FIG. 1 is a schematic block diagram of the apparatus.

Referring first to FIG. 1, the apparatus comprises a supply container 8 of paint or the like and a feed pump 9. In practice, the supply container 8 and feed pump 9 are in a separate room, often called the paint mixing room. A recirculating line, all of which is denoted with the numeral 10, runs from the supply container 8 and the pump 9 and back again to the supply container 8. The recirculating line 10 includes a supply line 10*a* and a return line 10*b*, the supply line 10*a* terminating in a pressure reducer 11 from which the return line 10*b* runs back to the supply container 8. Preferably, the supply line 10*a* and return line 10*b* of recirculating line 10 have the same cross-section and are assembled from modules. Between supply line 10*a* and return line 10*b* are switched spraying stations A, B, C and D, each of which comprises a tap valve 12, a metering pump 13, a sprayer 14, and a pressure reducer 15 (which follows the sprayer). In the drawing, these identical components of the four stations A through D are numbered 13A, 13B, etc. In addition, sensors 16 are included in the line system, in this case for the purpose of clarity, only the sensors are at comparable points in the area of spraying stations B, C, and D as well. The sensors 16 pick up the measurement values, to be explained hereinafter, of the paint flowing in the lines and send these values to a computer 17. Also for reasons of clarity, only the connecting line of one sensor 16 to the input of the computer 17 is shown in the drawing. The output of a typical input device 18, for example a keyboard, is connected to the input of the computer 17. The output of the computer 17 leads via a control line to the feed pump 9. In addition to what is shown, other components of the system or even all of the components can be controlled by the computer 17, the computer then controlling the program fed in and/or the input device 18 based on the measurement values of sensor 16.

To operate the apparatus, the known values of the paint being used, for example its viscosity at a specific temperature, its shearing loadability and the like, are fed into the computer 17 by means of the input device 18. As a function of the signals fed from the sensors 16 to the computer and which represent the pressure, the speed, the volume flow and/or the mass flow of the paint flowing at that respective point in the apparatus, the computer 17 then controls the feed pump 9 such that the variables, i.e., the pressure, speed, volume flow and/or mass flow, are at an optimal value, independent of whether the spraying stations are switched off or whether all or a portion of the spraying stations are switched on or are in operation.

To determine optimal values, generally the higher the variables are, the higher the loads to which the paint flowing in the recirculating line 10 is subjected and which results in a reduction in quality. This applies in particular if the duration of these loads is long, a state that is especially the case when the spraying stations are in the idle phases. When viewed over days or weeks, the idle phases are, of course, significantly lower than the operating phases (spray phases). In this case, the negative impact on the paint depends on the type and properties of the respective paint, and also on its respective viscosity, the viscosity changing with the temperature and, especially with many paints, even changing nonlinearly (a rheological paint structure). On the other hand, however, it is apparent that the variables cannot be reduced to any arbitrary value during the spraying process, the specific pressures, speeds and/or quantities of paint are required and when the spraying stations are in an idle phase, it must be assured that at the start of the spraying operation (opening of the tap valve and/or at the start of the spraying process), that there is no sudden rush-in in the line system and that the mandatory spray pressure and the mandatory spray quantity are there immediately. In addition, if the flow speeds are too low, there is the risk of deposits forming on the inner walls of the pipe, in particular in the case of those paints containing solid particles in suspension, for example, metallic paints. With the subject invention, the feed pump 9 is controlled by means of the computer 17 such that the paint is treated conservatively in all operational conditions, to the extent that this is possible based on the special properties and the requirements imposed on the apparatus to function faultlessly.

Figure 2:
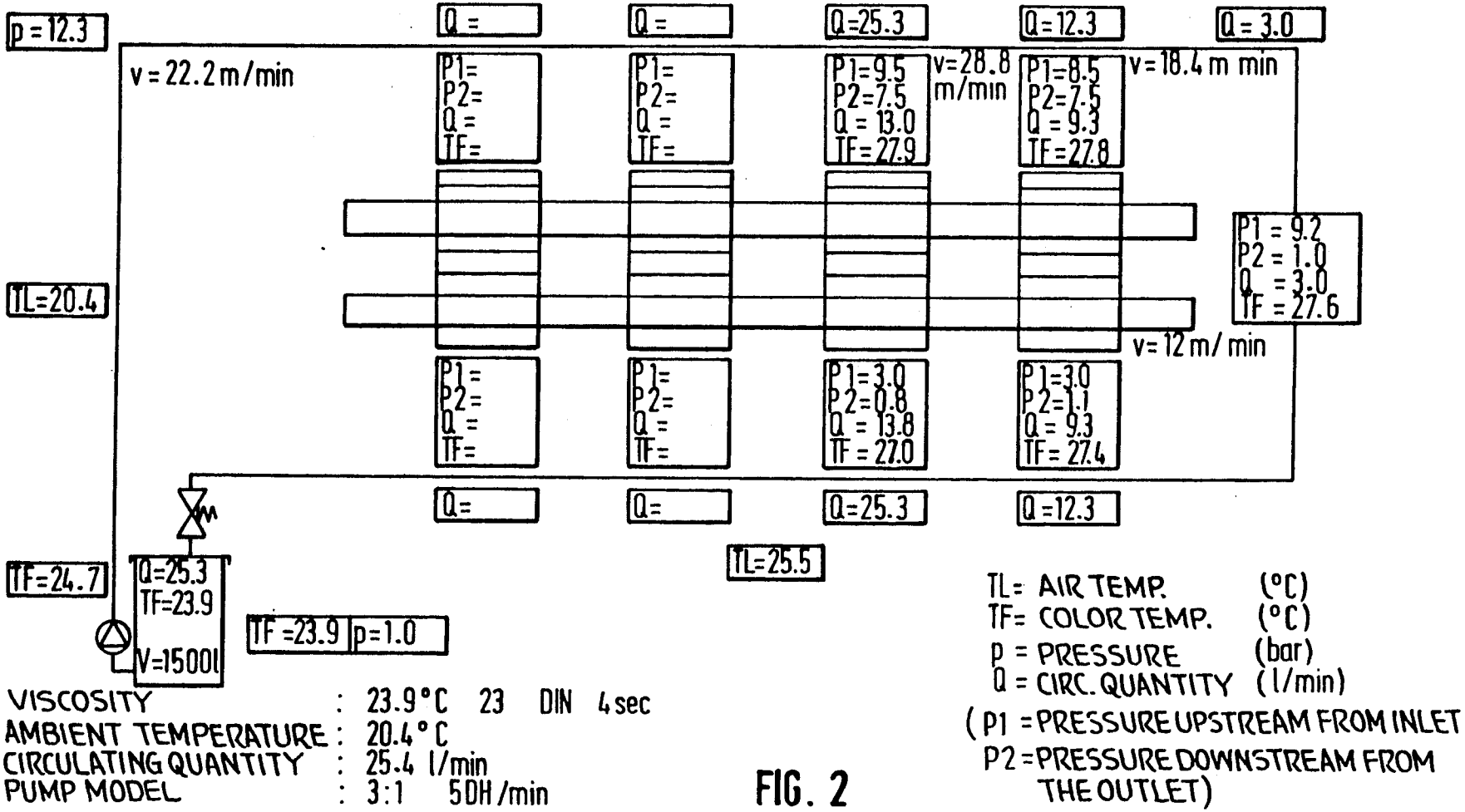
FIG. 2 is a measurement protocol of the apparatus of FIG. 1, shown as a numerical example.

FIG. 2 shows a typical measurement protocol for the apparatus of FIG. 1, where the numerical values given serve as an example only for a better appreciation and understanding of the invention. In this measurement protocol, spraying stations A and B of FIG. 1 are not in operation, i.e., the tap valves 12A and 12B are closed. On the other hand, the tap valves 12C and 12D at spraying stations C and D are open so that paint flows through, yet the sprayers 14C and 14D are not in operation. The individual numerical values at various points in the system are in themselves comprehensible and self-explanatory and therefore need no special explanation. However, it should be noted that the pressure downstream from the exit of pressure reducers 15C and 15D corresponds substantially to the pressure downstream from the exit of the pressure reducer 11,. This means that the pressure of the paint return of the spraying stations C and D is set in such a manner so as to ensure that the inflow into the return line 10*b* will be as calm as possible.

For the sake of simplicity and clarity, the embodiment of the invention explained with reference to the drawings shows only one recirculating line 10. In practice, however, there are generally at least several parallel recirculating lines, for example, five recirculating lines for paint of different colors and one recirculating line for flushing liquid. The tap valves at the individual spraying stations are then integrated into a so-called color changing unit, which can be controlled in such a manner that the paint of the desired color or the flushing liquid is fed into the common metering pump 13 and thus the sprayer 14. The pressure reducers 15 at the exit of the sprayers 14 are controlled analogously to the color changing units so that the discharging paint returns into the "correct" return line 10*b*. Of course, the various recirculating lines must be monitored and matched separately, because, as stated, the physical properties of the paints are different, even if the paints are the same basic type. The dimensioning of the apparatus thus depends on the respective percularities of the liquid, yet it should be observed that the recirculating lines, and in particular both the supply and the return lines, should run as close to the spraying station as possible in order to keep the distance between the tapping supply line and the flow into the return line to a minimum.

Figure 3:
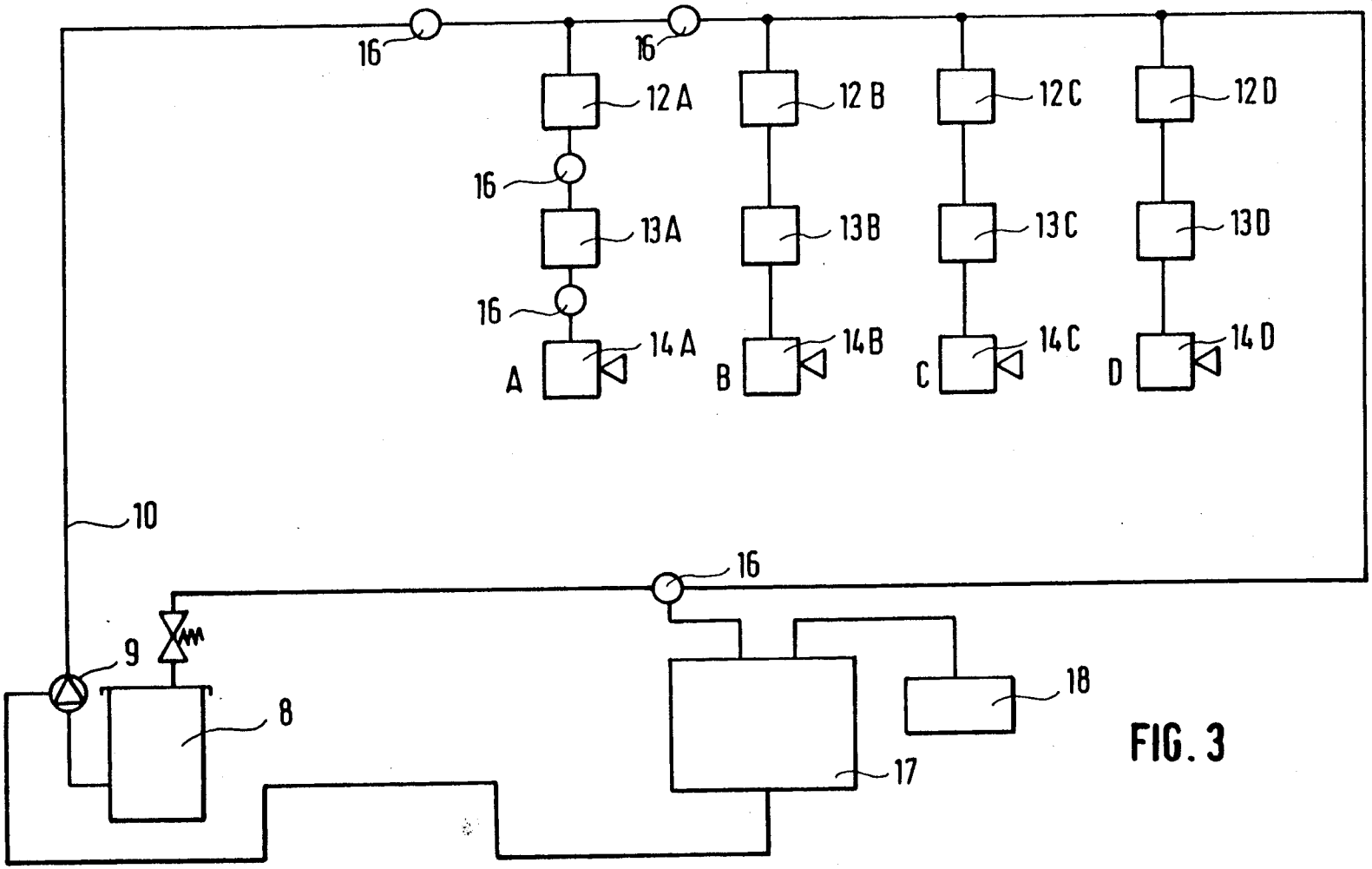
FIG. 3 is a schematic block diagram of an alternative embodiment of the apparatus of FIG. 1.

The embodiment illustrated in FIG. 1 can have numerous variations without departing from the scope and domain of the present invention, especially as to the components included in the apparatus. Thus, for example, if the accuracy of the spray pressure is not particularly important, the metering units 13 can be omitted. It is also possible to provide only tie lines to the sprayer 14 from the supply of the recirculating line. Thus, the sprayers are not connected to the return of the recirculating line, particularly if the paints being used do not have a tendency to settle. FIG. 3 shows such a apparatus in which the same components have the same reference numerals as the components of FIG. 1. Thus, in the system of FIG. 3, only tie lines lead from the recirculating line 10 to the sprayers 14, wherein even the subdivision of the recirculating line 10 by means of a pressure reducer 11 (FIG. 1) into the supply line and the return line can be omitted.

Furthermore, the computer 17 can be attached to a superordinate data processing system, resulting in a further automation of the aforementioned switching and matching processes of the subject apparatus.

While there has been shown and described what is considered to be preferred embodiments of the present invention, it will be apparent to those skilled in the art to which the invention pertains that various changes and modifications may be made therein departing from the invention as defined in the appended claims.

I claim:

1. In a spraying apparatus which comprises:

a supply container for containing a sprayable material;

a recirculating line which extends away from and back to said supply container, said recirculating line including a pressure reducer, a feed pump, a supply line leading from the feed pump to the pressure reducer, and a return line leading from the pressure reducer to the supply container;

a plurality of tapping lines connected between said supply line and said return line of said recirculating line, each of said tapping lines including a tap valve and a spraying station;

the improvement wherein said apparatus further includes:

a controller means connected to said feed pump to control is operation;

first sensor means connected to said recirculating line and said controller means for sending signals to said controller means representing the pressure, flow speed, volume flow and mass flow of said sprayable material flowing through said recirculating line, second sensor means connected to each of said tapping lines and said controller means for sensing signals to said controller means representing the open or closed state of the tap valve in each of said tapping lines, and input means connected to said controller means for inputting signals representing the shearing loadability and viscosity at specific temperatures of said sprayable material, said controller means causing the feed pump to operate so as to provide an optimum low pressure, flow speed, volume flow and mass flow of said sprayable material in said recirculating line.

2. A spraying apparatus as defined in claim 1, wherein each said tapping line includes a pressure reducer between said spraying station thereof and said return line.

* * * * *